US007782277B2

(12) United States Patent
Shin

(10) Patent No.: US 7,782,277 B2
(45) Date of Patent: Aug. 24, 2010

(54) DISPLAY DEVICE HAVING DEMULTIPLEXER

(75) Inventor: Dong-yong Shin, Seoul (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 961 days.

(21) Appl. No.: 11/112,835

(22) Filed: Apr. 22, 2005

(65) Prior Publication Data

US 2005/0264495 A1 Dec. 1, 2005

(30) Foreign Application Priority Data

May 25, 2004 (KR) ..... 10-2004-0037547

(51) Int. Cl.
*G09G 3/30* (2006.01)

(52) U.S. Cl. ..... 345/82

(58) Field of Classification Search ..... 345/76–83, 345/98–100, 690

See application file for complete search history.

(56) References Cited

U.S. PATENT DOCUMENTS 4,447,812 A 5/1984 Soneda et al.
5,426,447 A 6/1995 Lee
5,510,807 A 4/1996 Lee et al.
5,555,001 A 9/1996 Lee et al.
5,633,653 A 5/1997 Atherton
5,708,454 A 1/1998 Katoh et al.
5,892,493 A 4/1999 Enami et al.
6,097,362 A * 8/2000 Kim ..... 345/87
6,333,729 B1 12/2001 Ha
6,348,906 B1 * 2/2002 Dawson et al. ..... 345/82
6,359,608 B1 3/2002 Lebrun et al.
6,559,836 B1 5/2003 Mori (Continued)

FOREIGN PATENT DOCUMENTS

CN 1116454 A 2/1996

(Continued)

OTHER PUBLICATIONS

SIPO Patent Gazette, dated Oct. 8, 2008, for Chinese application 200510073819.1, noting references listed in this IDS.

(Continued)

*Primary Examiner*—Chanh Nguyen
*Assistant Examiner*—Allison Walthall
(74) *Attorney, Agent, or Firm*—Christie, Parker & Hale, LLP

(57) ABSTRACT

A display device and a demultiplexer. A display device includes plural pixels for displaying an image corresponding to first data currents, each pixel including plural sub-pixels. The display device also includes plural scan lines for applying scan signals to the pixels; plural first data lines for applying the first data currents to the pixels; a scan driver for outputting the scan signals to the scan lines; a demultiplexer including plural demultiplexing circuits; and a data driver for transmitting second data currents to plural second data lines. The demultiplexing circuits demultiplex second data currents into first data currents, and transmit the first data currents to the first data lines. A pre-charge voltage is applied to the first data lines before the first data currents are transmitted. This way, the data driver is simplified, and the first data lines are pre-charged with a suitable voltage before programming data, thereby reducing programming time.

18 Claims, 10 Drawing Sheets

U.S. PATENT DOCUMENTS

| | | | | |
|---|---|---|---|---|
| 6,667,580 | B2 | 12/2003 | Kim et al. | |
| 6,731,266 | B1 | 5/2004 | Jung | |
| 6,771,028 | B1 | 8/2004 | Winters | |
| 6,924,784 | B1 * | 8/2005 | Yeo et al. | 345/98 |
| 7,015,882 | B2 | 3/2006 | Yumoto | |
| 7,038,652 | B2 * | 5/2006 | Kang et al. | 345/98 |
| 7,180,497 | B2 * | 2/2007 | Lee et al. | 345/98 |
| 7,193,619 | B2 | 3/2007 | Kimura | |
| 7,253,665 | B2 | 8/2007 | Kimura | |
| 7,256,756 | B2 | 8/2007 | Abe | |
| 7,259,740 | B2 * | 8/2007 | Haga et al. | 345/98 |
| 7,310,092 | B2 | 12/2007 | Imamura | |
| 7,324,079 | B2 | 1/2008 | Tobita | |
| 7,342,559 | B2 | 3/2008 | Shin | |
| 7,403,176 | B2 | 7/2008 | Chung et al. | |
| 7,468,718 | B2 | 12/2008 | Shin | |
| 7,505,017 | B1 | 3/2009 | Yeo et al. | |
| 2003/0030602 | A1 | 2/2003 | Kasai | |
| 2003/0107561 | A1 | 6/2003 | Uchino et al. | |
| 2003/0132907 | A1 | 7/2003 | Lee et al. | |
| 2003/0179164 | A1 * | 9/2003 | Shin et al. | 345/76 |
| 2004/0032382 | A1 * | 2/2004 | Cok et al. | 345/82 |
| 2004/0056852 | A1 * | 3/2004 | Shih et al. | 345/204 |
| 2004/0227749 | A1 | 11/2004 | Kimura | |
| 2005/0052890 | A1 | 3/2005 | Morita | |
| 2005/0110727 | A1 | 5/2005 | Shin | |

FOREIGN PATENT DOCUMENTS

| | | | |
|---|---|---|---|
| CN | 1301377 | A | 6/2001 |
| CN | 1417771 | A | 5/2003 |
| CN | 1432989 | A | 7/2003 |
| CN | 1447302 | A | 10/2003 |
| CN | 1488131 | | 4/2004 |
| GB | 2 384 102 | A | 7/2003 |
| JP | 02-306293 | | 12/1990 |
| JP | 06-118913 | | 4/1994 |
| JP | 2000-122607 | | 4/2000 |
| JP | 2000-356978 | | 12/2000 |
| JP | 2002-40961 | | 2/2002 |
| JP | 2002-351357 | | 12/2002 |
| JP | 2003-058108 | | 2/2003 |
| JP | 2003-76327 | | 3/2003 |
| JP | 2003-114645 | | 4/2003 |
| JP | 2003-157048 | | 5/2003 |
| JP | 2003-177722 | | 6/2003 |
| JP | 2003-195812 | | 7/2003 |
| JP | 2003-195815 | | 7/2003 |
| JP | 2003-330386 | | 11/2003 |
| JP | 2004-029528 | | 1/2004 |
| JP | 2004-29755 | | 1/2004 |
| JP | 2004-145224 | | 5/2004 |
| JP | 2005-70227 | | 3/2005 |
| KR | 2003-0075946 | | 9/2003 |
| WO | WO 02/39420 | A1 | 5/2002 |
| WO | WO 03/038796 | A1 | 5/2003 |
| WO | WO 03/038797 | | 5/2003 |
| WO | WO 03/091980 | A1 | 11/2003 |
| WO | WO 2004/077671 | A1 | 9/2004 |

OTHER PUBLICATIONS

U.S. Office action dated Jan. 6, 2009, for related U.S. Appl. No. 10/990,659, indicating relevance of listed reference in this IDS.

China Office action dated Jun. 8, 2007, for CN 200510070218.5, and English translation.

T. Kretz et al; "A 3.4-inch Reflective Colour Active Matrix Liquid Crystal Display without Polarisers"; SID 02 Digest, May 2002, pp. 798-801.

M. Ohta et al; "A Novel Current Programmed Pixel for Active Matrix OLED Displays"; SID 03 Digest, May 20, 2003, pp. 108-111.

European Search Report, dated Sep. 22, 2005, for Application No. 05103845.3-2205, in the name of Samsung SDI Co., Ltd.

European Search Report dated Apr. 2, 2008, for European application 05103845.3, indicating relevance of U.S. Patent 6,559,836 listed in this IDS.

U.S. Notice of Allowance dated Dec. 2, 2008, for related U.S. Appl. No. 10/997,486, noting listed reference in this IDS.

U.S. Office action dated Feb. 18, 2009, for related U.S. Appl. No. 11/124,926, noting listed rerferences in this IDS.

U.S. Office action dated Jun. 2, 2009, for related U.S. Appl. No. 11/124,926, noting U.S. Publication 2005/0110727 listed in this IDS.

U.S. Notice of Allowance dated Jul. 9, 2009, for related U.S. Appl. No. 10/992,327, noting U.S. Patents listed in this IDS.

U.S. Office action dated Jul. 13, 2009, for related U.S. Appl. No. 10/990,659, noting U.S. Publication 2003/0030602 listed in this IDS.

Japanese Office action dated Oct. 6, 2009, for corresponding Japanese application 2004-336903m noting listed international publication in this IDS.

Chinese Office action for corresponding China Patent Application 2005100738191, indicating relevance of CN 1447302 and JP 2004-29755 listed in this IDS, 2007.

Patent Abstracts of Japan, Publication No. 2000-122607, dated Apr. 28, 2000, in the name of Norio Ozawa.

Patent Abstracts of Japan, Publication No. 2000-356978; Publication Date: Dec. 26, 2000; in the name of Yeo et al.

Patent abstract of Japan for publication No. 2002-040961, dated Feb. 8, 2002 in the name of Yoshiharu Hashimoto.

Patent abstract of Japan for publication No. 2003-076327; dated Mar. 14, 2003 in the name of Koichi Iguchi.

Patent Abstracts of Japan, Publication No. 2003-114645, dated Apr. 18, 2003, in the name of Toshiyuki Kasai.

Patent Abstracts of Japan, Publication No. 2003-195812, dated Jul. 9, 2003, in the name of Katsumi Abe.

Patent Abstracts of Japan, Publication No. 2003-195815, dated Jul. 9, 2003, in the name of Akira Yumoto.

Patent abstract of Japan for publication No. 2003-330386; dated Nov. 19, 2003 in the name of Hajime Akimoto, et al.

Patent Abstract of Japan, Publication No. 2004-029755, dated Jan. 29, 2004, in the name of Hiroshi Takahara.

Patent Abstracts of Japan, Publication No. 2005-070227, dated Mar. 17, 2005, in the name of Norio Ozawa.

Korean Patent Abstracts for Publication No. 1020030075946, Date of publication of application Sep. 26, 2003, in the name of O Gyeong Kwon et al.

Korean Official Action for Korean patent application 10-2004-0037547, 2006.

English Abstract of Chinese Patent Gazette for related China Patent 100409282C, listing China references noted in this IDS, 2008.

U.S. Office action dated Sep. 30, 2008, for related U.S. Appl. No. 11/124,926, indicating relevance of listed U.S. and Japan references in this IDS.

* cited by examiner

DISPLAY DEVICE HAVING DEMULTIPLEXER

CROSS-REFERENCE TO RELATED APPLICATIONS

This application claims priority to and the benefit of Korean Patent Application No. 10-2004-0037547, filed May 25, 2004, in the Korean Intellectual Property Office, the entire disclosure of which is incorporated herein by reference.

BACKGROUND

1. Field of the Invention

The present invention relates to a display device and a demultiplexer, and more particularly to an organic electroluminescent display and a demultiplexer, in which a demultiplexer includes a demultiplexing circuit including a sample/hold circuit and a pre-charge switching circuit.

2. Discussion of Related Art

An organic electroluminescent display is based on a phenomenon that an exciton emits light of a specific wavelength in an organic thin film, wherein the exciton is formed by recombination of an electron and a hole injected from a cathode and an anode, respectively. The organic electroluminescent display includes a self-emitting device, unlike a liquid crystal display (LCD), so that a separate light source is not needed. In the organic electroluminescent display, the brightness of an organic electroluminescent device varies according to the quantity of current flowing through an organic light-emitting device or organic light-emitting diode (OLED).

The organic electroluminescent display can be classified as a passive matrix type or an active matrix type according to its driving method. In the case of the passive matrix type, the anode and the cathode are perpendicularly disposed and form a line to be selectively driven. The passive matrix type organic electroluminescent display can be easily realized due to a relatively simple structure, but is not suitable for realizing a large-sized screen because it consumes much more power and the time allotted to drive each light-emitting device is shortened. On the other hand, in the case of the active matrix type, an active device is used to control the quantity of current flowing through the light-emitting device. As the active device, a thin film transistor (hereinafter, referred to as "TFT") is widely used. The active matrix type organic electroluminescent display has a relatively complicated structure, but it consumes relatively little power and the time allotted to drive each organic electroluminescent device is relatively longer.

Hereinbelow, a conventional organic electroluminescent display will be described with reference to FIGS. 1 and 2.

FIG. 1 is a view showing a conventional organic electroluminescent display having an active matrix of n×m pixels.

Referring to FIG. 1, a conventional organic electroluminescent display includes a panel 11, a scan driver 12, and a data driver 13. The panel 11 includes n×m pixels 14, n scan lines SCAN[1], SCAN[2], . . . , SCAN[n] formed horizontally, and m data lines DATA[1], DATA[2], . . . , DATA[m] formed vertically, where n and m are natural numbers. Here, the scan driver 12 transmits scan signals to the pixels 14 through the scan lines SCAN[1] to SCAN[n], and the data driver 23 applies data voltages to the pixels 14 through the data lines DATA[1] to DATA[m].

FIG. 2 is a circuit diagram of a pixel employed in the organic electroluminescent display of FIG. 1. In FIG. 2, DATA represents one of the data lines of FIG. 1, and SCAN represents one of the scan lines of FIG. 1.

Referring to FIG. 2, a pixel of a conventional organic electroluminescent display includes an organic light emitting device OLED, a driving transistor MD, a capacitor C, and a switching transistor MS. The driving transistor MD is connected to the organic light emitting device OLED, and supplies a current to the organic light emitting device to emit light. Further, the switching transistor MS applies a data voltage to control the quantity of current supplied by the driving transistor MD. Further, the capacitor C is connected between a source and a gate of the driving transistor MD, and maintains a voltage corresponding to the data voltage applied by the switching transistor MS for a predetermined period.

With this configuration, when a scan signal is applied to a gate of the switching transistor MS and thus the switching transistor MS is turned on, the data voltage is applied to the gate of the driving transistor MD through the data line DATA. Accordingly, as the data voltage is applied to the gate of the driving transistor MD, the driving transistor MD supplies a current to the organic light emitting device OLED, thereby allowing the organic light emitting device OLED to emit light.

At this time, the current flowing through the organic light emitting device OLED is based on the following Equation 1.

$$I_{OLED}=I_D=(\beta/2)(V_{GS}-V_{TH})^2=(\beta/2)(V_{DD}-V_{DATA}-|V_{TH}|)^2, \quad \text{[Equation 1]}$$

where $I_{OLED}$ is a current flowing through the organic light emitting device, $I_D$ is a current flowing from the source to a drain of the driving transistor MD, $V_{GS}$ is a voltage applied between the gate and the source of the driving transistor MD, $V_{TH}$ is a threshold voltage of the driving transistor MD, $V_{DD}$ is a power voltage, $V_{DATA}$ is a data voltage, and β is a gain factor.

Referring back to FIG. 1, in the conventional organic electroluminescent display, the data driver 13 is directly connected to the data lines of the pixels. Therefore, when the number of data lines is increased, the data driver 13 becomes more complex in proportion to the number of data lines. On the other hand, even though the data driver 13 is realized as a chip separately from the panel 11, when the number of data lines is increased, the number of pins for the data driver 13 and the number of interconnection lines connecting the data driver 13 and the panel 11 should be increased in proportion to the number of data lines, thereby increasing production costs and circuit mounting space needed.

The current driving method can be classified as a voltage programming type or a current programming type. In the case of a current programming type pixel circuit, there is an advantage that display characteristics such as brightness are substantially uniform as long as the power source substantially uniformly supplies current to a pixel circuit even though the driving transistors for the respective pixels have different voltage-current property from each other.

However, in the current programming type pixel circuit in which the current is used as an input data signal for the pixel, voltage charged in a parasitic capacitor of the data line DATA by a data current of a preceding pixel line has an effect on the data programming time. Therefore, particularly, in the case of low gradation, data programming speed is lowered.

SUMMARY OF THE INVENTION

Accordingly, it is an aspect of the present invention to provide a display device and a demultiplexer, in which the demultiplexer is provided between the data driver and a panel, and includes demultiplexing circuits, each comprising sample/hold circuits and a pre-charge switching circuit. The display device, for example, can be an organic electroluminescent display.

To achieve the forgoing and/or other aspects of the present invention, in an exemplary embodiment according to the present invention, a display device including a plurality of pixels for displaying an image corresponding to first data currents, each of the pixels including a plurality of sub-pixels, is provided. The display device also includes a plurality of scan lines, a plurality of first data lines, a scan driver, a data driver, and a demultiplexer including a plurality of demultiplexing circuits. Scan signals are applied to the plurality of pixels through the plurality of scan lines. The first data currents are transmitted to the plurality of pixels through the plurality of first data lines. The scan driver outputs the scan signals to the plurality of scan lines, and the data driver transmits second data currents to a plurality of second data lines. Each of the demultiplexing circuits demultiplexes a corresponding one of the second data currents transmitted through one of the second data lines into at least two of the first data currents, and transmits the at least two of the first data currents to at least two of the first data lines. A pre-charge voltage is applied to the at least two of the first data lines before the at least two of the first data currents are transmitted to the at least two of the first data lines.

In another exemplary embodiment according to the present invention, a demultiplexer including a plurality of demultiplexing circuits, a plurality of sample signal lines, first and second hold signal lines, and a pre-charge signal line, is provided. Sampling signals are applied to the demultiplexing circuits through the plurality of sample signal lines. Holding signals are applied to the demultiplexing circuits through the first and second hold signal lines. A pre-charging signal is applied to the demultiplexing circuits through the pre-charge signal line. At least one of the demultiplexing circuits demultiplexes an input data current transmitted through an input data line into output data currents in response to the sampling and holding signals, and transmits the output data currents to a plurality of output data lines. A pre-charge voltage is applied to the output data lines before the output data currents are transmitted to the output data lines.

In yet another exemplary embodiment according to the present invention, a demultiplexer including a plurality of demultiplexing circuits, a plurality of sample signal lines, first and second hold signal lines, a pre-charge signal line, and a pre-charge voltage line, is provided. Sampling signals are applied to the demultiplexing circuits through the plurality of sample signal lines. Holding signals are applied to the demultiplexing circuits through the first and second hold signal lines. A pre-charging signal is applied to the demultiplexing circuits through the pre-charge signal line. A pre-charge voltage is applied to the demultiplexing circuits through the pre-charge signal line. At least one of the demultiplexing circuits demultiplexes an input data current transmitted through an input data line into output data currents in response to the sampling and holding signals, and transmits the output data currents to a plurality of output data lines. The pre-charge voltage is applied to the output data lines before the output data currents are transmitted to the output data lines.

BRIEF DESCRIPTION OF THE DRAWINGS

These and/or other aspects of the present invention will become apparent and more readily appreciated from the following description of certain exemplary embodiments, taken in conjunction with the accompanying drawings of which.

DETAILED DESCRIPTION

Hereinafter, exemplary embodiments of a display device according to the present invention will be described in detail with reference to FIGS. 3 through 12, wherein the display device according to the present invention is not limited to, and may be applied to various displays including a current programming method type pixel circuit. The display device can be an organic electroluminescent display device, for example.

Figure 1:
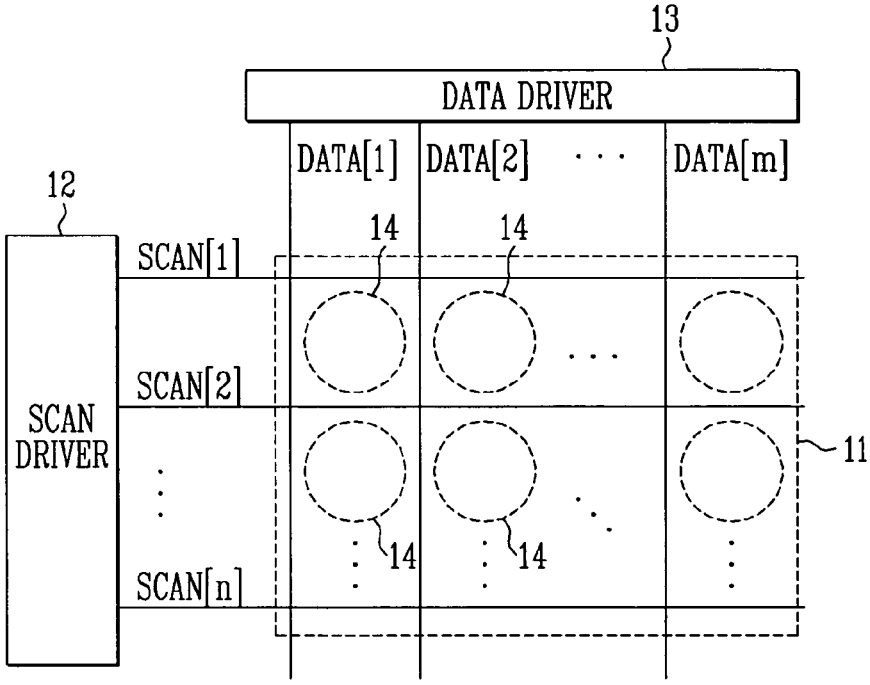
FIG.1 PRIOR ART
FIG. 1 is a view showing a conventional organic electroluminescent display having an active matrix of n×m pixels.
Figure 2:
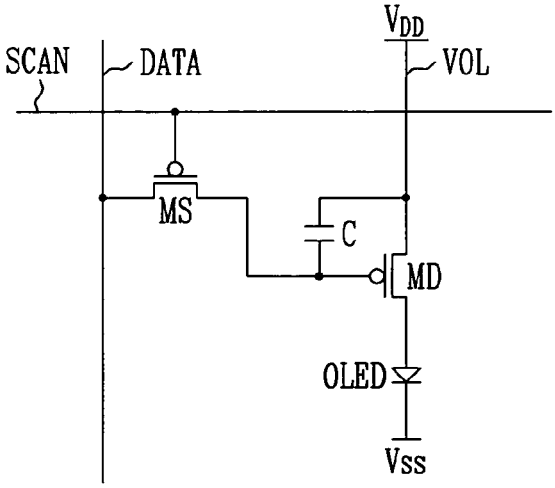
FIG.2 PRIOR ART
FIG. 2 is a circuit diagram of a pixel employed in the conventional organic electroluminescent display of FIG. 1.
Figure 3:
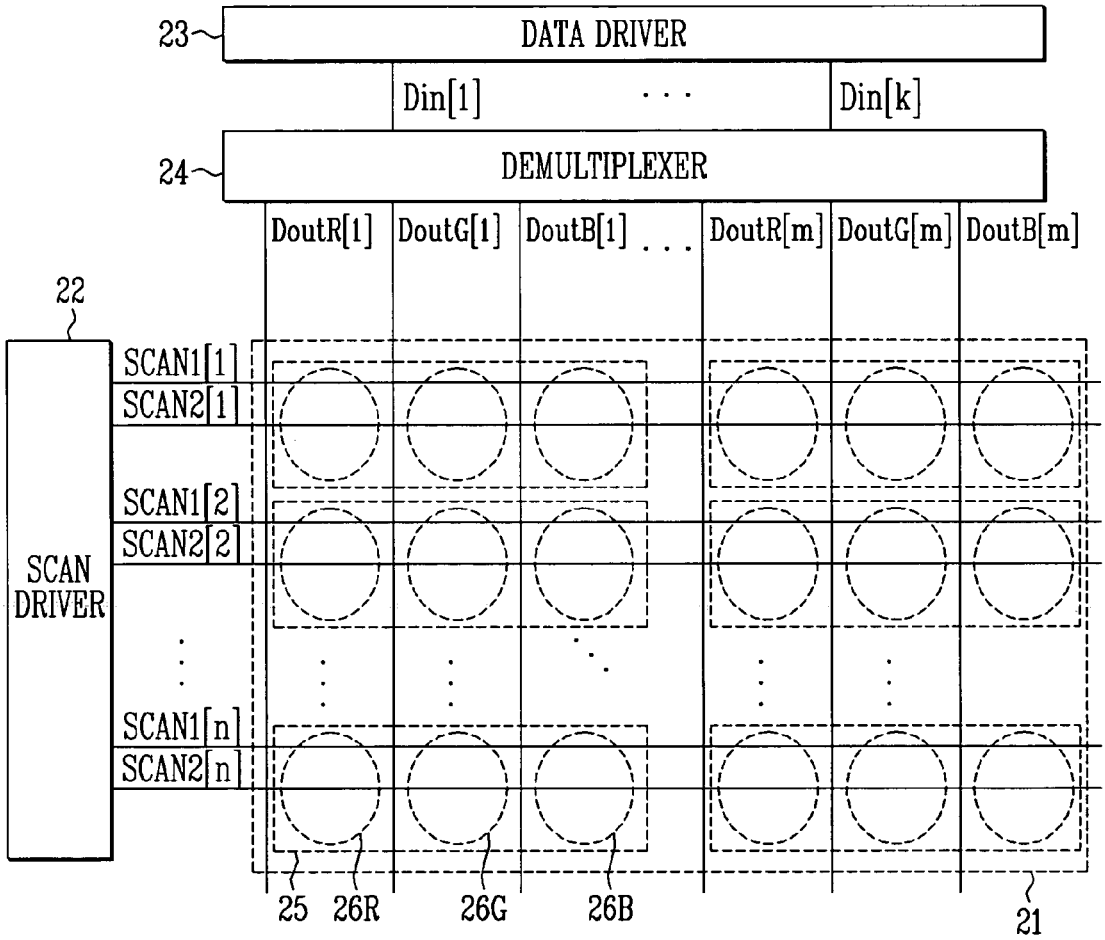
FIG. 3 is a circuit diagram of an organic electroluminescent display having an active matrix of n×m pixels according to an exemplary embodiment of the present invention.

FIG. 3 is a circuit diagram of an organic electroluminescent display having an active matrix of n×m pixels according to an exemplary embodiment of the present invention.

Referring to FIG. 3, an organic electroluminescent display according to an exemplary embodiment of the present invention includes a panel 21, a scan driver 22, a data driver 23, and a demultiplexer 24.

The panel 21 includes n×m pixels 25; n first scan lines SCAN1[1], SCAN1[2], . . . , SCAN1[n] and n second scan lines SCAN2[1], SCAN2[2], . . . , SCAN2[n], which are horizontally formed; and 3 m output data lines DoutR[1], DoutG[1], DoutB[1], . . . , DoutR[m], DoutG[m], DoutB[m], which are vertically formed, where n and m are natural numbers. As an elementary unit representative of color, each pixel 25 includes three sub-pixels 26R, 26G, 26B, that is, a red sub-pixel 26R, a green sub-pixel 26G, and a blue sub-pixel 26B. The first and second scan lines SCAN1, SCAN2 (e.g., one of the first scan lines SCAN1[1] to SCAN1[n] and one of the second scan lines SCAN2[1] to SCAN2[n]) respectively transmit first and second scan signals to the pixel 25. The red, green and blue output data lines DoutR, DoutG, DoutB (e.g., one of the red output data lines DoutR[1] to DoutR[m], one of the green output data lines DoutG[1] to DoutG[m], and one of the blue output data lines DoutB[1] to DoutB[m]) respectively transmit output data currents to the red, green, blue sub-pixels 26R, 26G, 26B. The sub-pixels 26R, 26G, 26B are operated by a current programming method. That is, a capacitor (e.g., a capacitor C' of FIG. 4) is charged with voltage corresponding to the current flowing in the output data lines DoutR, DoutG, DoutB for a selection period, and then a current is supplied to an organic light emitting device (e.g., OLED of FIG. 4) in correspondence to the voltage of the capacitor for a light emission period.

The scan driver 22 transmits the first and second scan signals to the first and second scan lines SCAN1, SCAN2.

The data driver 23 transmits input data currents to k input data lines Din[1], Din[2], . . . Din[k]. Here, k is equal to 1.5 m when the demultiplexer 24 is a 1:2 demultiplexer. The data driver 23 can include a pre-charge voltage supplying part (not shown) to supply the pre-charge voltage to k input data lines Din[1], Din[2], . . . Din[k].

The demultiplexer 24 receives the input data currents and demultiplexes them into output data currents, thereby transmitting the output data currents and the pre-charge voltage to 3 m output data lines DoutR[1], DoutG[1], DoutB[1], . . . , DoutR[m], DoutG[m], DoutB[m]. The demultiplexer 24 includes k sample/hold type demultiplexing circuits, examples of which are shown in FIGS. 6, 7, 9 and 10. Each demultiplexing circuit is a 1:2 demultiplexing circuit, so that the input data current transmitted to one input data line Din is demultiplexed and transmitted to two output data lines. At this time, the pre-charge voltage is applied to the output data line before transmitting the output data current.

Figure 4:
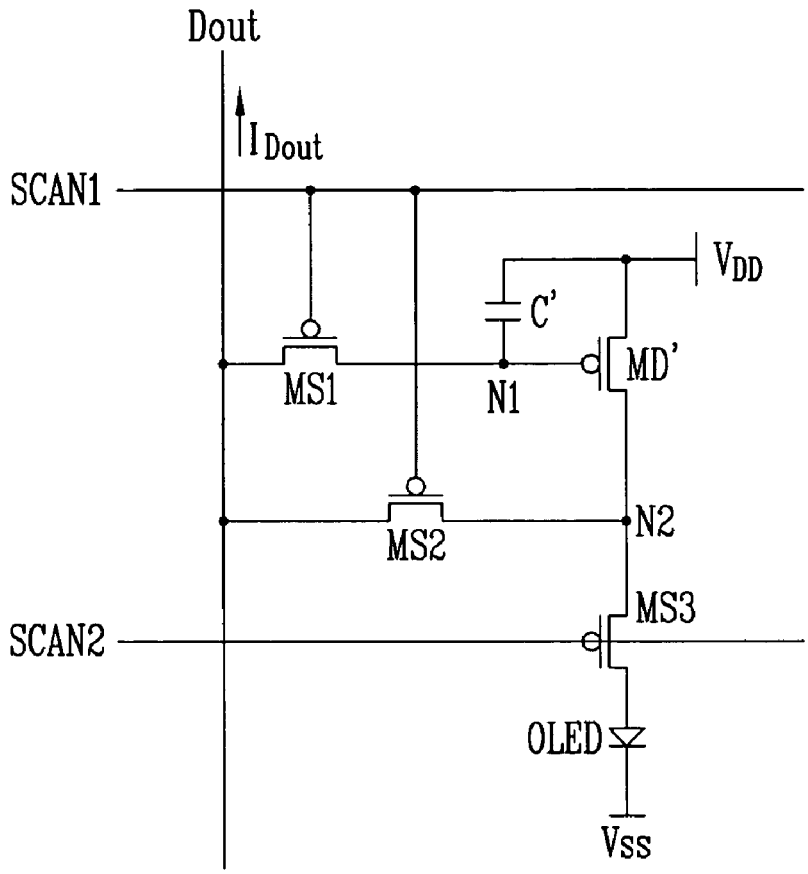
FIG. 4 is a circuit diagram of a pixel employed in the organic electroluminescent display of FIG. 3.

FIG. 4 is a circuit diagram of a sub-pixel employed in the organic electroluminescent display of FIG. 3. In FIG. 4, SCAN1 represents one of the first scan lines SCAN1[1] to SCAN1[n] of FIG. 3, and SCAN2 represents one of the second scan lines SCAN2[1] to SCAN2[n]. Further, Dout represents one of the data lines DoutR[1], DoutG[1], DoutB[1], . . . , DoutR[m], DoutG[m], DoutB[m].

Referring to FIG. 4, a sub-pixel includes an organic light emitting device OLED and a sub-pixel circuit. The sub-pixel circuit includes a driving transistor MD'; first, second, third switching transistors MS1, MS2, MS3; and a capacitor C'. Each of the driving transistor MD', and the first, second, and third switching transistors MS1, MS2, MS3 includes a gate, a source and a drain. The capacitor C' includes a first terminal and a second terminal.

The first switching transistor MS1 includes the gate connected to the first scan line SCAN1, the source connected to a first node N1, and the drain connected to the output data line Dout. The output data line Dout is one of the red, green and blue output data lines illustrated in FIG. 3. The first switching transistor MS1 charges the capacitor C' in response to the first scan signal of the first scan line SCAN1.

The second switching transistor MS2 includes the gate connected to the first scan line SCAN1, the source connected to a second node N2, and the drain connected to the output data line Dout. The second switching transistor MS2 transmits the output data current $I_{Dout}$ flowing in the output data line Dout to the driving transistor MD' in response to the first scan signal of the first scan line SCAN1.

The third switching transistor MS3 includes the gate connected to the second scan line SCAN2, the source connected to the second node N2, and the drain connected to the organic light emitting device OLED. The third switching transistor MS3 transmits a current flowing through the driving transistor MD' to the organic light emitting device OLED in response to the second scan signal of the second scan line SCAN2.

The capacitor C' includes the first terminal to which the power voltage $V_{DD}$ is applied, and the second terminal connected to the first node N1. While the first and second switching transistors MS1, MS2 are turned on, the capacitor C' is charged corresponding to the voltage $V_{GS}$ between the gate and the source according to the output data current $I_{Dout}$ flowing in the driving transistor MD'. On the other hand, while the first and second switching transistors MS1, MS2 are turned off, the capacitor C' substantially maintains the voltage $V_{GS}$.

The driving transistor MD' includes the gate connected to the first node N1, the source to which the power voltage $V_{DD}$ is applied, and the drain connected to the second node N2. While the third switching transistor MS3 is turned on, the driving transistor MD' supplies a current to the organic light emitting device OLED, wherein the current corresponds to the voltage applied between the first and second terminals of the capacitor C'.

Figure 5:
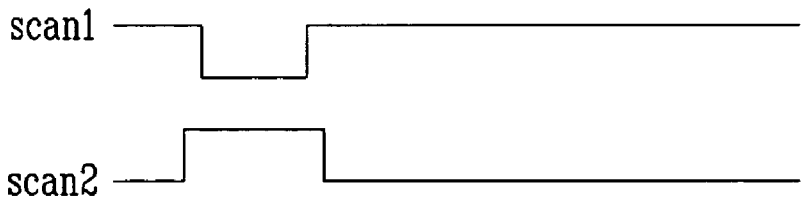
FIG. 5 is a timing diagram of signals for driving the pixel of FIG. 4.

FIG. 5 is a timing diagram of signals for driving the sub-pixel of FIG. 4, wherein the signals include first and second scan signals scan1, scan2.

Referring to FIGS. 4 and 5, operation of the sub-pixel circuit will be described hereinbelow. For the selection period when the first and second scan signal scan 1, scan 2 are low and high, respectively, the first and second switching transistors MS1, MS2 are turned on and the third switching transistor MS3 is turned off. For the selection period, the output data current $I_{Dout}$ flowing in the output data line Dout is transmitted to the driving transistor MD'. Here, the voltage $V_{GS}$ between the gate and the source of the driving transistor MD' is determined on the basis of the following Equation 2, and the capacitor C' is charged with an electric charge corresponding to the voltage $V_{GS}$ applied between the gate and the source thereof.

$$I_D=I_{Dout}=(\beta/2)(V_{GS}-V_{TH})^2 \quad \text{[Equation 2]}$$

For the light emission period when the first and second scan signals scan1, scan2 are high and low, respectively, the third switching transistor MS3 is turned on and the first and second switching transistors MS1, MS2 are turned off. Because the electric charge charged in the capacitor C' for the selection period is maintained for the light emission period, the voltage between the first and second terminals of the capacitor C' is determined for the selection period, that is, the voltage $V_{GS}$ between the gate and the source of the driving transistor MD' is maintained for the light emission period. Referring to Equation 2, the current $I_D$ flowing in the driving transistor MD' is determined based on the voltage $V_{GS}$ between the gate and the source, so that the output data current $I_{Dout}$ is flowing in the driving transistor MD' not only for the selection period but also for the light emission period. Therefore, the current $I_{OLED}$ flowing in the organic light-emitting device is determined on the basis of the following Equation 3.

$$I_{OLED}=I_D=I_{Dout} \quad \text{[Equation 3]}$$

Referring to Equation 3, the current $I_{OLED}$ flowing in the organic light emitting device OLED of the sub-pixel shown in FIG. 4 is equal to the output data current $I_{Dout}$, so that the current $I_{OLED}$ flowing in the organic light emitting device OLED is not affected by a threshold voltage $V_{TH}$ of the driving transistor MD'. That is, the foregoing sub-pixel circuit is not affected by the threshold voltage $V_{TH}$ of the driving transistor MD'.

Figure 6:
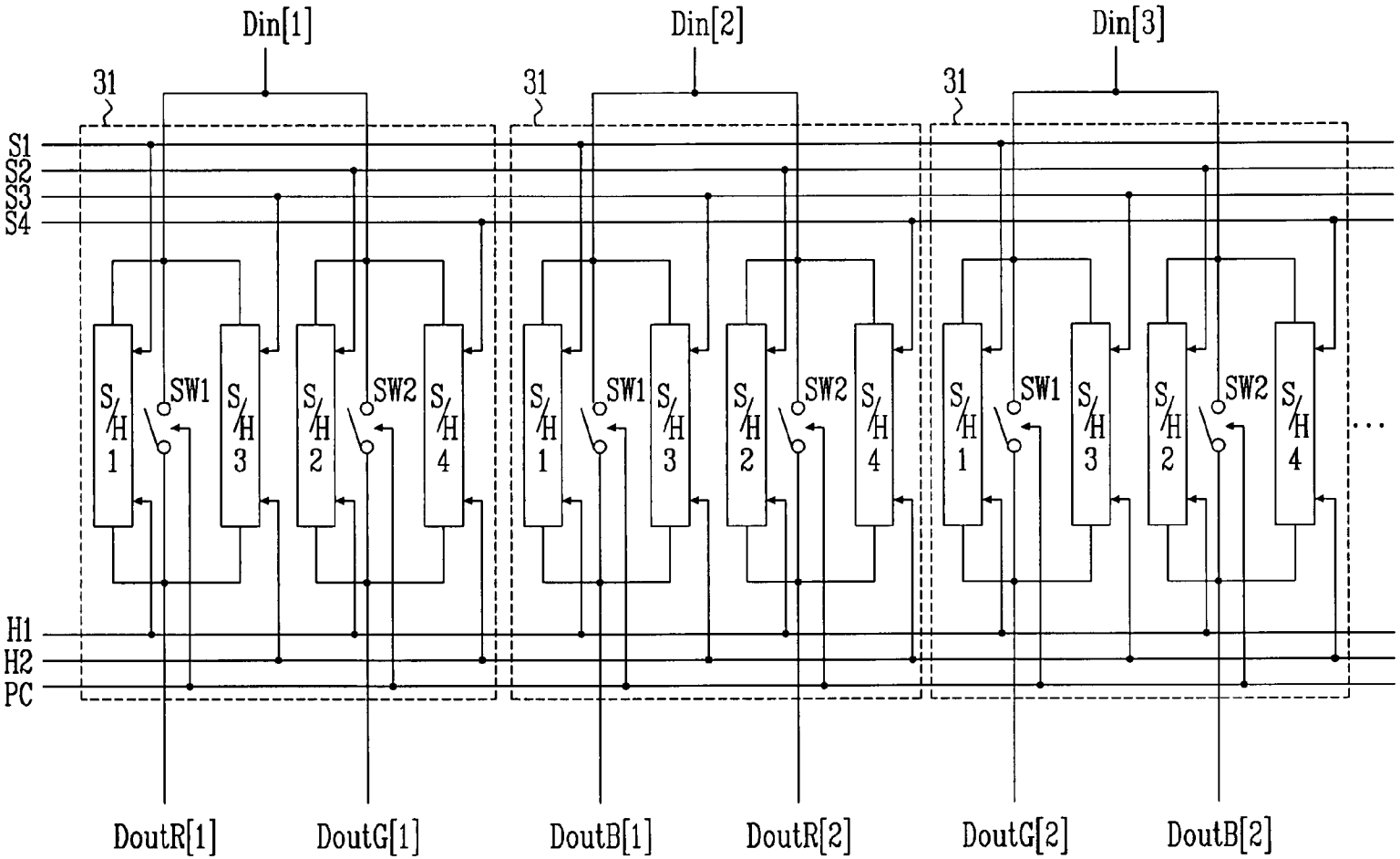
FIG. 6 is a circuit diagram of a demultiplexer according to a first exemplary embodiment of the present invention, which can be employed in the organic electroluminescent display of FIG. 3.

FIG. 6 is a circuit diagram of a demultiplexer according to a first exemplary embodiment of the present invention, which can be employed in the organic electroluminescent display of FIG. 3, for example.

Referring to FIG. 6, the demultiplexer includes k demultiplexing circuits 31.

Each demultiplexing circuit 31 includes a sample/hold type 1:2 demultiplexing circuit, so that the input data current transmitted to one input data line Din is demultiplexed and transmitted to two output data lines. Two output data lines are connected to a sub-pixel group including two sub-pixels having different colors, for example, a group of red and green sub-pixels, a group of blue and red sub-pixels, or a group of green and blue sub-pixels. Also, a first red output data line DoutR[1] and a first green output data line DoutG[1] are connected to a first demultiplexing circuit; a first blue output data line DoutB[1] and a second red output data line DoutR[2] are connected to a second demultiplexing circuit; a second green output data line DoutG[2] and a second blue output data line DoutB[2] are connected to the third demultiplexing circuit, and so on. Here, the pre-charge voltage is applied to each output data line before transmitting the output data to the output data line.

Each demultiplexing circuit 31 includes first through fourth sample/hold circuits S/H1~S/H4, and first and second pre-charge switches SW1, SW2. Here, first through fourth sample lines S1~S4, first and second hold lines H1, H2, and a pre-charge signal line PC are connected to each demultiplexing circuit 31.

The first sample/hold circuit S/H1 records a voltage corresponding to a current transmitted to the input data line Din (e.g., one of Din[1] to Din[k] for this and other sample/hold circuits) in a capacitor (e.g., a capacitor $C_{hold}$ of FIG. 12 in this and other sample/hold circuits) in response to a first sampling signal of the first sample line S1, and then transmits a current corresponding to the voltage recorded in the capacitor to the output data line Dout (e.g., DoutR[1]) in response to a first hold signal of the first hold line H1.

The second sample/hold circuit S/H2 records a voltage corresponding to a current transmitted to the input data line Din in a capacitor (e.g., shown in FIG. 12) in response to a second sampling signal of the second sample line S2, and then transmits a current corresponding to the voltage recorded in the capacitor to the output data line Dout (e.g., DoutG[1]) in response to the first holding signal of the first hold line H1.

The third sample/hold circuit S/H3 records a voltage corresponding to a current transmitted to the input data line Din in a capacitor (e.g., shown in FIG. 12) in response to a third sampling signal of the third sample line S3, and then transmits a current corresponding to the voltage recorded in the capacitor to the output data line Dout (e.g., DoutR[1]) in response to the second holding signal of the second hold line H2.

The fourth sample/hold circuit S/H4 records a voltage corresponding to a current transmitted to the input data line Din in a capacitor (e.g., shown in FIG. 12) in response to a fourth sampling signal of the fourth sample line S4, and then transmits a current corresponding to the voltage recorded in the capacitor to the output data line Dout (e.g., DoutG[1]) in response to a second holding signal of the second hold line H2.

The first pre-charge switch SW1 is connected to opposite terminals of the first and third sample/hold circuits S/H1, S/H3, and transmits the pre-charge voltage to the output data line Dout (e.g., DoutR[1]) in response to the pre-charging signal applied through the pre-charge signal line PC.

The second pre-charge switch SW2 is connected to opposite terminals of the second and fourth sample/hold circuits S/H2, S/H4, and transmits the pre-charge voltage to the output data line Dout (e.g., DoutG[1]) in response to the pre-charging signal transmitted to the pre-charge signal line PC.

With this configuration, the demultiplexer illustrated in FIG. 6 can apply the pre-charge voltage to the output data line Dout before transmitting the data current, thereby reducing the time it takes to charge/discharge the parasitic capacitor connected to (i.e., a parasitic capacitance associated with) the output data line Dout. Therefore, it is possible to reduce the time it takes to program the data to the pixel connected to the output data line Dout. Here, the pre-charge voltage can have a predetermined voltage level, for example, a voltage level corresponding to black gradation.

Figure 7:
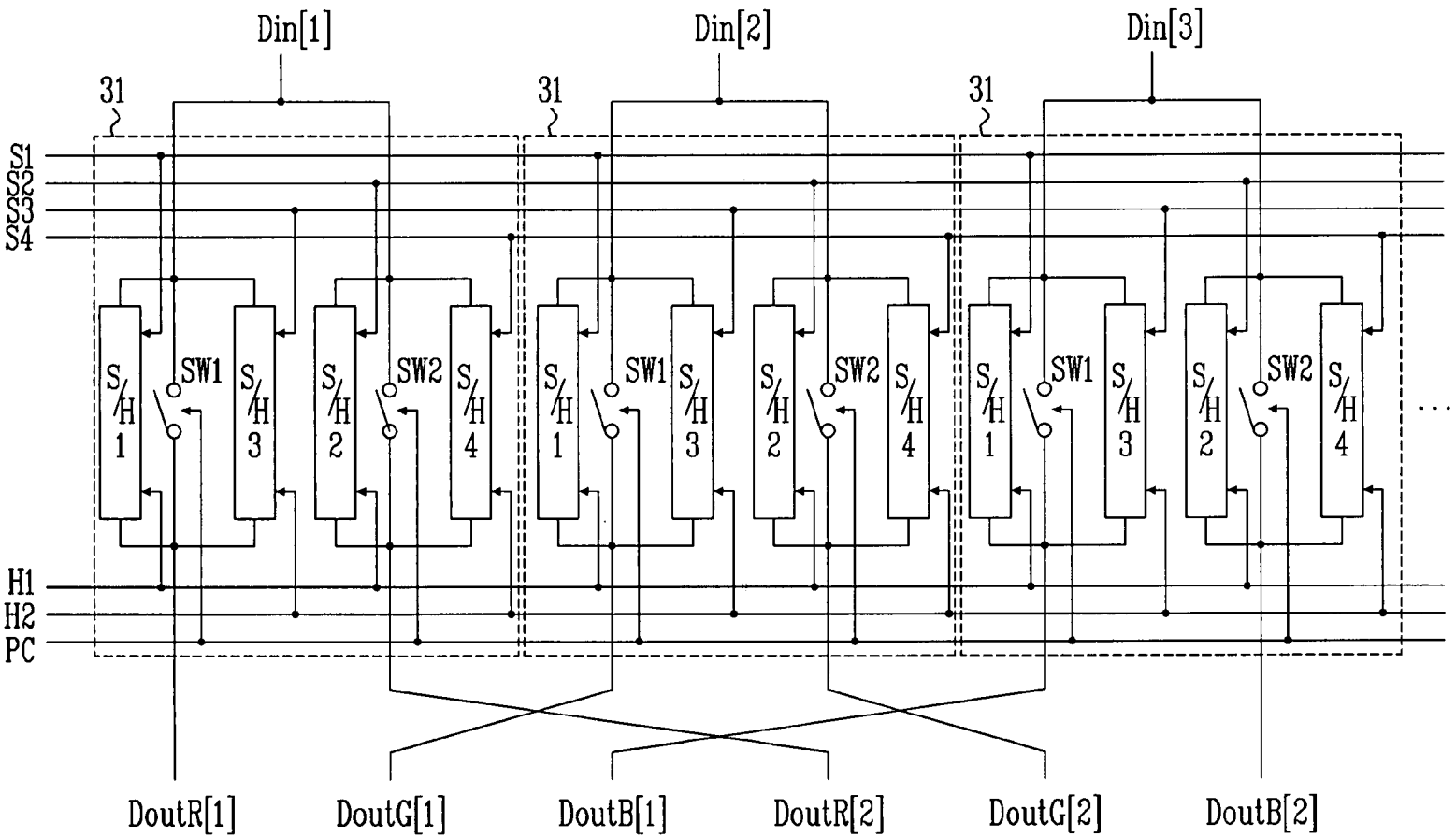
FIG. 7 is a circuit diagram of a demultiplexer according to a second exemplary embodiment of the present invention, which can be employed in the organic electroluminescent display of FIG. 3.

FIG. 7 is a circuit diagram of a demultiplexer according to a second exemplary embodiment of the present invention, which can be employed in the organic electroluminescent display of FIG. 3, for example.

Referring to FIG. 7, the demultiplexer includes k demultiplexing circuits 31.

Each demultiplexing circuit 31 includes a sample/hold type 1:2 demultiplexing circuit, so that the input data current transmitted to one input data line Din is demultiplexed and transmitted to two output data lines. Unlike the demultiplexer of FIG. 6, two output data lines of the demultiplexer shown in FIG. 7 are connected to a sub-pixel group including two sub-pixels having the same color, for example, a group of red sub-pixels DoutR[1], DoutR[2]; a group of green sub-pixels DoutG[1], DoutG[2]; or a group of blue sub-pixels DoutB[1], DoutB[2]. Additionally, a first red output data line DoutR[1] and a second red output data line DoutR[2] are connected to a first demultiplexing circuit; a first green output data line DoutG[1] and a second green output data line DoutG[2] are connected to a second demultiplexing circuit; a first blue output data line DoutB[1] and a second blue output data line DoutB[2] are connected to the third demultiplexing circuit; and so on.

Figure 8:
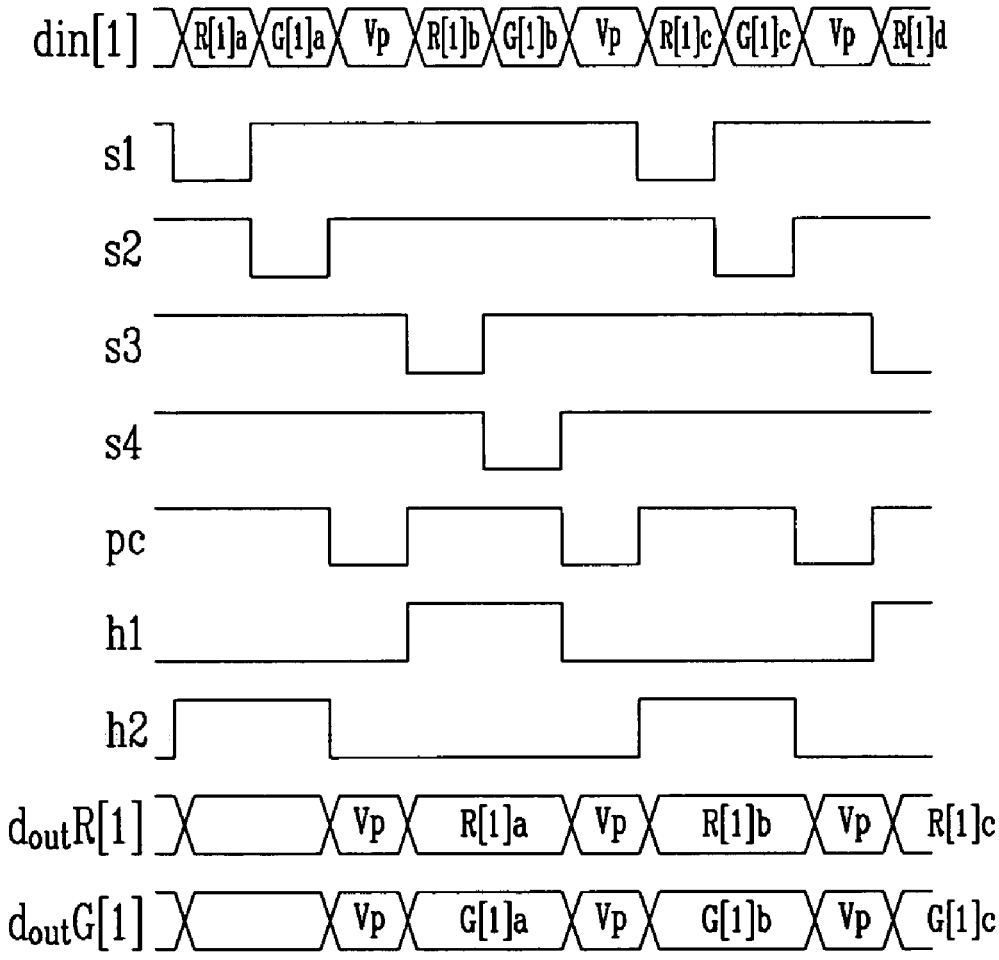
FIG. 8 is a timing diagram of input and output signals of the demultiplexer of FIG. 6.

FIG. 8 is a timing diagram of input and output signals of the demultiplexer of FIG. 6.

FIG. 8 illustrates input data din[1]; first through fourth sampling signals s1 through s4; first and second holding signals h1, h2; a pre-charging signal pc; and red and green output data doutR[1], doutG[1]. FIG. 8 illustrates the signals with the assumption that the sample/hold circuit of FIG. 6 samples the current transmitted to the input data line in response to the low sampling signal, and transmits current corresponding to the sampled current to the output data line in response to the high sampling signal.

Referring to FIGS. 6 and 8, the demultiplexing circuit 31 operates as follows. Since each of the demultiplexing circuit 31 operates in substantially the same manner, the description of operation will be given below in reference to the demultiplexing circuit 31 connected to the output data lines DoutR[1] and DoutG[1] only. For a period when the first sampling signal s1 is low, the current value R[1]*a* of the input data din[1] is sampled and stored in the first sample/hold circuit S/H1. For a period when the second sampling signal s2 is low, the current value G[1]*a* of the input data din[1] is sampled and stored in the second sample/hold circuit S/H2. During these periods of time, the pre-charging signal pc is high, so that the first and second pre-charge switches SW1, SW2 are turned off.

Then, for a period while the pre-charging signal pc is low, the first and second pre-charge switches SW1, SW2 are turned on, thereby applying the pre-charge voltage to the output data lines DoutR[1], DoutG[1]. At this time, substantially the same pre-charge voltage Vp is applied to the red and green output data lines DoutR[1], DoutG[1].

Then, for a period when the third sampling signal s3 is low, a current value R[1]*b* of the input data din[1] is sampled and stored in the third sample/hold circuit S/H3. For a period when the fourth sampling signal s4 is low, a current value G[1]*b* of the input data din[1] is sampled and stored in the fourth sample/hold circuit S/H4. During these periods, the first holding signal h1 is high, so that the first and second sample/hold circuits S/H1, S/H2, to which the first hold signal h1 is applied, respectively transmit currents corresponding to the sampled current values R[1]*a*, G[1]*a* to the output data lines DoutR[1], DoutG[1]. During these times, the pre-charging signal pc is high, so that the first and second pre-charge switches SW1, SW2 are turned off.

Then, for a period when the pre-charging signal pc is low, the first and second pre-charge switches SW1, SW2 are turned on and supply the pre-charge voltage to the output data lines DoutR[1], DoutG[1]. At this time, substantially the same pre-charge voltage Vp is supplied to the red and green output data lines DoutR[1], DoutG[1].

Then, for a period when the first sampling signal s1 is low, a current value R[1]*c* of the input data din[1] is sampled and stored in the first sample/hold circuit S/H1. For a period when the second sampling signal s2 is low, the current value G[1]*c* of the input data din[1] is sampled and stored in the second sample/hold circuit S/H2. During these periods of time, the second holding signal h2 is high, so that the third and fourth sample/hold circuits S/H3, S/H4, to which the second hold signal h2 is applied, respectively transmit currents corresponding to the sampled current values R[1]*c*, G[1]*c* to the output data lines DoutR[1], DoutG[1].

As described above, the sample/hold type demultiplexing circuit demultiplexes the input data inputted to the input data line Din[1], transmits them to the output data line DoutR[1], DoutG[1], and transmits the pre-charge voltage inputted to the input data line Din[1] to the output data lines DoutR[1], DoutG[1]. Further, substantially the same pre-charge voltage is supplied to each of the red, green and blue sub-pixels that form one pixel.

Further, the demultiplexer shown in FIG. 7 transmits the same signal as shown in FIG. 8, and therefore applies substantially the same pre-charge voltage to every pixel regardless of colors of the pixel connected to the output data lines. Alternatively, the demultiplexer may apply a pre-charge voltage adapted to the group of red sub-pixels connected to the output data lines DoutR[1], DoutR[2], to the group of red sub-pixels; a pre-charge voltage adapted to the group of green sub-pixels connected to the output data lines DoutG[1], DoutG[2], to the group of green sub-pixels; and a pre-charge voltage adapted to the group of blue sub-pixels connected to the output data lines DoutB[1], DoutB[2], to the group of blue sub-pixels.

Figure 9:
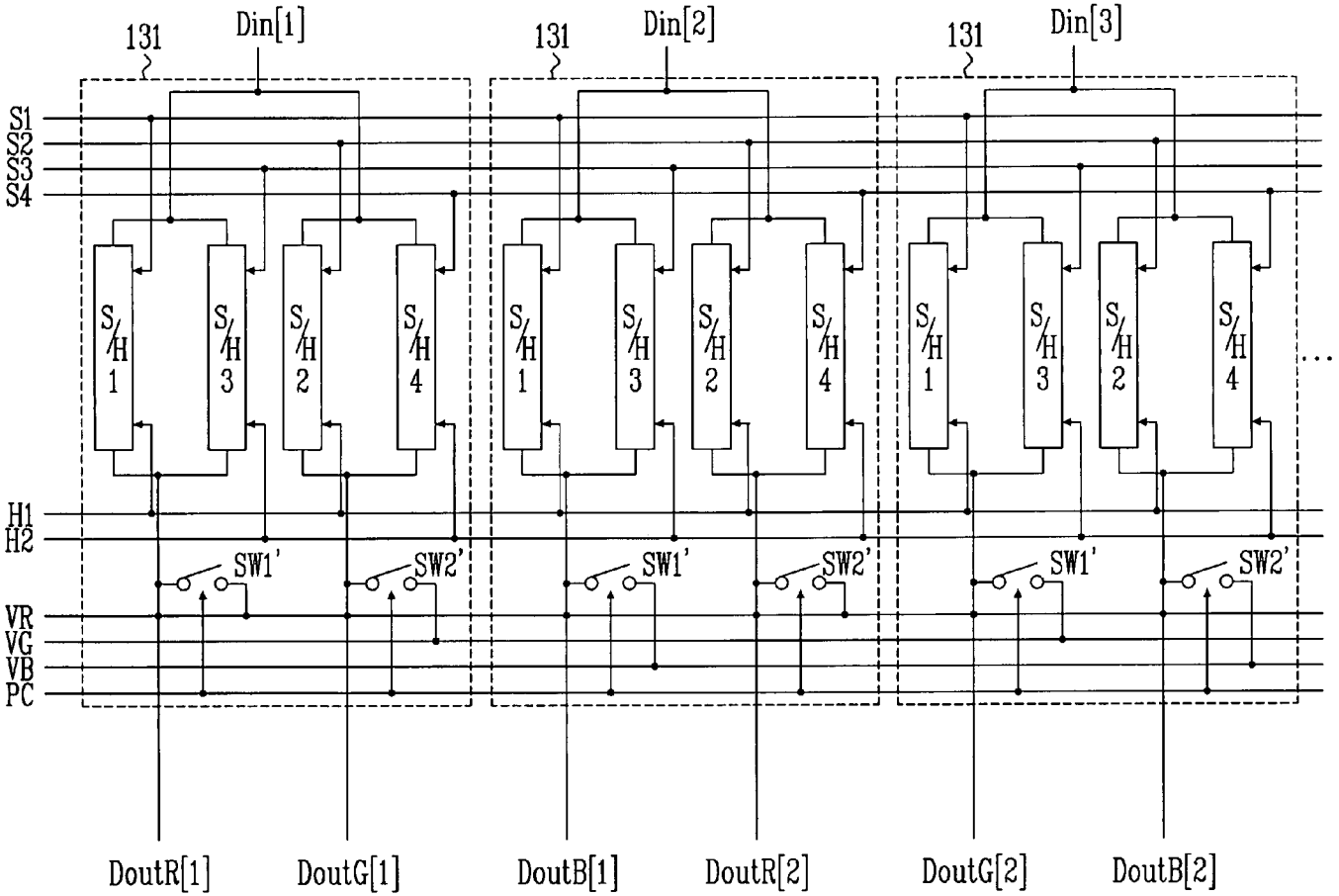
FIG. 9 is a circuit diagram of a demultiplexer according to a third exemplary embodiment of the present invention, which can be employed in the organic electroluminescent display of FIG. 3.

FIG. 9 is a circuit diagram of a demultiplexer according to a third exemplary embodiment of the present invention, which can be employed in the organic electroluminescent display of FIG. 3, for example.

Referring to FIG. 9, the demultiplexer includes k demultiplexing circuits 131. Each demultiplexing circuit 131 includes a sample/hold type 1:2 demultiplexing circuit, so that the input data current transmitted to one input data line Din is demultiplexed and transmitted to two output data lines. Two output data lines are connected to a sub-pixel group including two sub-pixels having different colors, for example, a group of red and green sub-pixels, a group of blue and red sub-pixels, and a group of green and blue sub-pixels. Additionally, a first red output data line DoutR[1] and a first green output data line DoutG[1] are connected to a first demultiplexing circuit; a first blue output data line DoutB[1] and a second red output data line DoutR[2] are connected to a second demultiplexing circuit; a second green output data line DoutG[2] and a second blue output data line DoutB[2] are connected to the third demultiplexing circuit, and so on. Here, the pre-charge voltage is transmitted to each output data line before transmitting the output data to the output data line.

Each demultiplexing circuit 131 includes first through fourth sample/hold circuits S/H1~S/H4, and first and second pre-charge switches SW1', SW2'. Here, first through fourth sample lines S1~S4; first and second hold lines H1, H2; pre-charge voltage lines VR, VG, VB for red, green and blue sub-pixels; and a pre-charge signal line PC are connected to each demultiplexing circuit 131.

Here, the first through fourth sample/hold circuits S/H1~S/H4 have substantially the same operation as the sample/hold circuits of FIG. 6, except for the application of the pre-charge voltages, and therefore repetitive descriptions thereof will be avoided.

The first pre-charge switch SW1' has one terminal connected to each output terminal of the first and third sample/hold circuits S/H1, S/H3, and transmits the pre-charge voltage to the output data line Dout in response to the pre-charging signal applied through the pre-charge signal line PC. For example, when one terminal of the first pre-charge switch SW1' is connected to the output data line connected with the red sub-pixel, the pre-charge voltage line VR for the red sub-pixel is connected to the red output data line DoutR (e.g., one of DoutR[1] to DoutR[m]).

The second pre-charge switch SW2' is connected to each output terminal of the second and fourth sample/hold circuits S/H2, S/H4, and transmits the pre-charge voltage to the output data line Dout in response to the pre-charging signal transmitted to the pre-charge signal line PC. For example, when one terminal of the second pre-charge switch SW2' is connected to the output data line connected with the green sub-pixel, the pre-charge voltage line VG for the green sub-pixel is connected to the green output data line DoutG (e.g., one of DoutG[1] to DoutG[m]).

Figure 10:
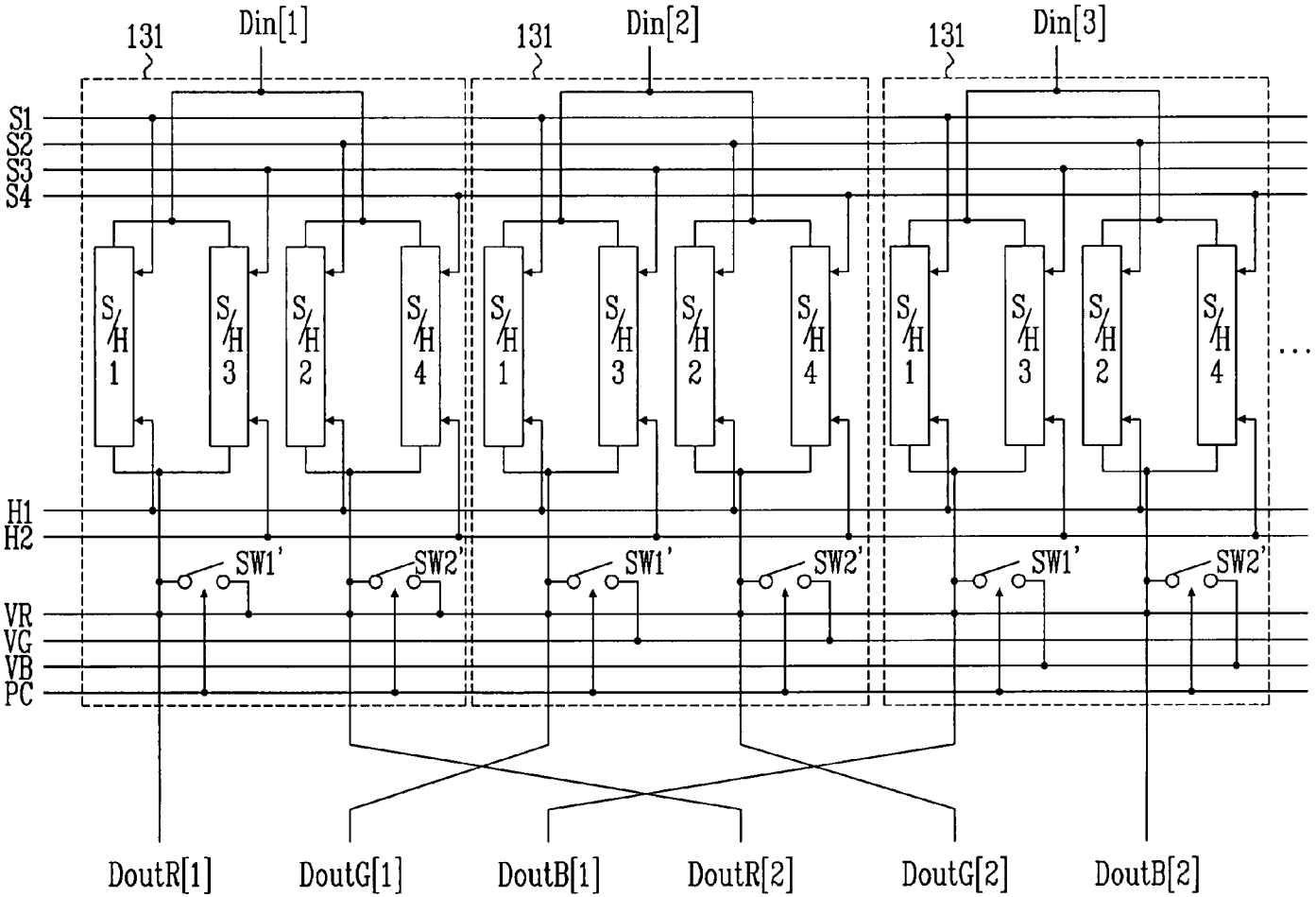
FIG. 10 is a circuit diagram of a demultiplexer according to a fourth exemplary embodiment of the present invention, which can be employed in the organic electroluminescent display of FIG. 3.

FIG. 10 is a circuit diagram of a demultiplexer according to a fourth exemplary embodiment of the present invention, which can be employed in the organic electroluminescent display of FIG. 3, for example.

Referring to FIG. 10, the demultiplexer includes k demultiplexing circuits 131. Each demultiplexing circuit 131 includes a sample/hold type 1:2 demultiplexing circuit, so that the input data current transmitted to one input data line Din is demultiplexed and transmitted to two output data lines. Unlike the demultiplexer of FIG. 9, two output data lines of the demultiplexer shown in FIG. 10 are connected to a sub-pixel group including two sub-pixels having the same color. For example, a group of red sub-pixels are connected to the output data lines DoutR[1], DoutR[2]; a group of green sub-pixels are connected to the output data lines DoutG[1], DoutG[2]; and a group of blue sub-pixels are connected to the output data lines DoutB[1], DoutB[2]. In more detail, a first red output data line DoutR[1] and a second red output data line DoutR[2] are connected to a first demultiplexing circuit; a first green output data line DoutG[1] and a second green output data line DoutG[2] are connected to a second demultiplexing circuit; a first blue output data line DoutB[1] and a second blue output data line DoutB[2] are connected to the third demultiplexing circuit; and so on.

With this configuration, it is possible to supply the pre-charge voltage preset according to the sub-pixel groups to the sub-pixels of the same color. Alternatively, unlike the demultiplexer of FIGS. 9 and 10 which include the plurality of pre-charge voltage lines VR, VG, VB, the demultiplexer may supply substantially the same pre-charge voltage from one pre-charge voltage line to the output data lines regardless of the colors of the sub-pixels.

Figure 11:
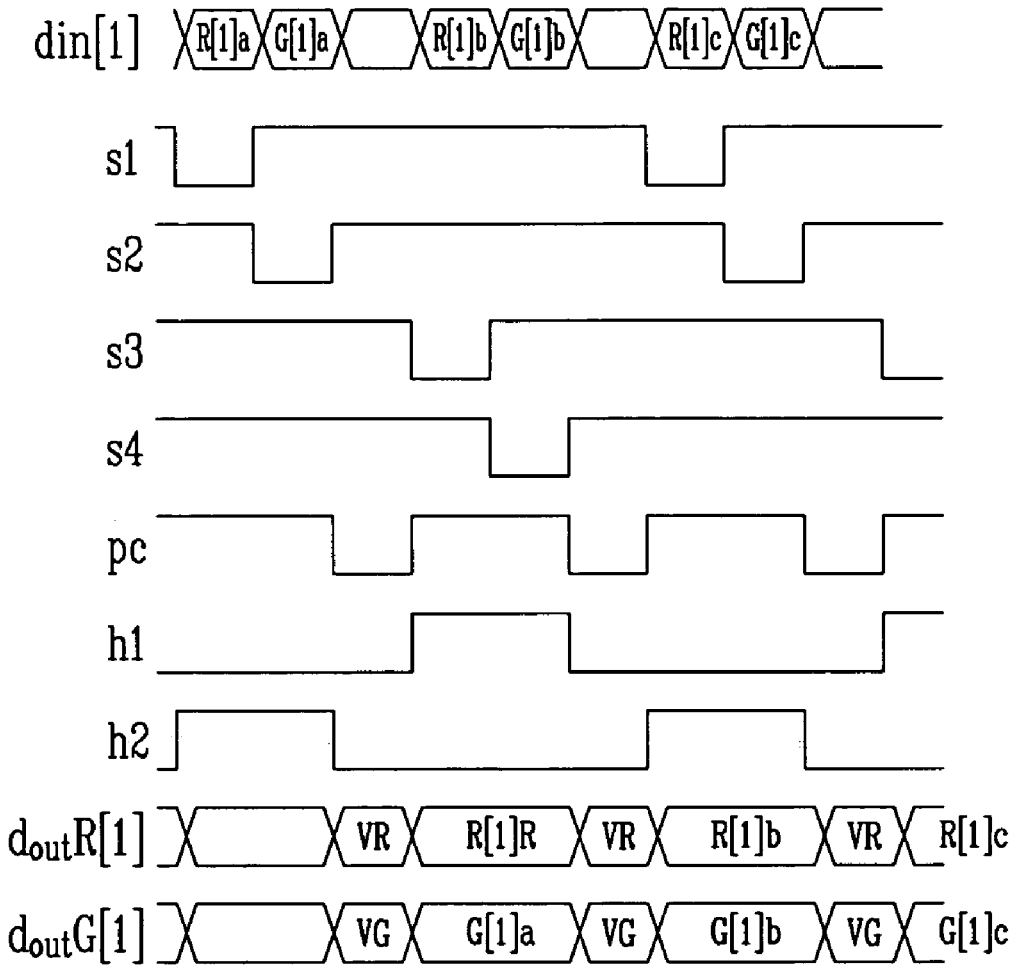
FIG. 11 is a timing diagram of input and output signals of the demultiplexer of FIG. 9.

FIG. 11 is a timing diagram of input and output signals of the demultiplexer of FIG. 9.

FIG. 11 illustrates input data din[1]; first through fourth sampling signals s1 through s4; first and second holding signals h1, h2; a pre-charging signal pc; and red and green output data doutR[1], doutG[1].

Referring to FIGS. 9 and 11, the demultiplexing circuit operates as follows. For a period when the first sampling signal s1 is low, the current value R[1]*a* of the input data din[1] is sampled and stored in the first sample/hold circuit S/H1. For a period when the second sampling signal s2 is low, the current value G[1]*a* of the input data din[1] is sampled and stored in the second sample/hold circuit S/H2. During this period, the pre-charging signal pc is high, so that the first and second pre-charge switches SW1', SW2' are turned off.

Then, for a period when the pre-charging signal pc is low, the first and second pre-charge switches SW1', SW2' are turned on, thereby applying the red and green pre-charge voltages VR, VG to the output data lines DoutR[1], Dout G[1]. At this time, the red and green pre-charge voltages VR, VG are supplied to the red and green output data lines DoutR [1], DoutG[1], respectively.

Then, for a period when the third sampling signal s3 is low, a current value R[1]*b* of the input data din[1] is sampled and stored in the third sample/hold circuit S/H3. For a period when the fourth sampling signal s4 is low, a current value G[1]*b* of the input data din[1] is sampled and stored in the fourth sample/hold circuit S/H4. During these periods, the first holding signal h1 is high, so that the first and second sample/hold circuits S/H1, S/H2, to which the first hold signal h1 is applied, respectively transmit currents corresponding to the sampled current values R[1]*a*, G[1]*a* to the output data lines DoutR[1], DoutG[1]. During these periods of time, the pre-charging signal pc is high, so that the first and second pre-charge switches SW1, SW2 are turned off.

Then, for a period when the pre-charging signal pc is low, the first and second pre-charge switches SW1', SW2' are turned on and respectively supply the pre-charge voltages VR, VG to the output data lines DoutR[1], DoutG[1]. At this time, the different pre-charge voltages VR, VG are supplied to the red and green output data lines DoutR[1], DoutG[1].

Then, for a period when the first sampling signal s1 is low, a current value R[1]*c* of the input data din[1] is sampled and stored in the first sample/hold circuit S/H1. For a period when the second sampling signal s2 is low, a current value G[1]*c* of the input data din[1] is sampled and stored in the second sample/hold circuit S/H2. During these periods of time, the second holding signal h2 is high, so that the third and fourth sample/hold circuits S/H3, S/H4, to which the second hold signal h2 is applied, respectively transmit currents corresponding to the sampled current values R[1]*c*, G[1]*c* to the output data lines DoutR[1], DoutG[1].

Thus, each demultiplexer samples the input data, applies the pre-charge voltage to the output data lines, and holds the sampled input data. While the sampled input data is held, the other input data is sampled.

With this configuration and operation of the demultiplexer, the pre-charge voltage is applied differently to each of the red, green and blue sub-pixels that form one pixel.

The demultiplexer shown in FIG. 10 also applies different pre-charge voltages to output data lines connected to different color sub-pixels, in a similar manner as the demultiplexer of FIG. 9. More specifically, the levels of the pre-charge voltage applied to the group of the sub-pixels are different according to the group of red sub-pixels connected to the output data lines DoutR[1], DoutR[2], the group of green sub-pixels connected to the output data lines DoutG[1], DoutG[2], and the group of blue sub-pixels connected to the output data lines DoutB[1], DoutB[2]. As described above, in the demultiplexer according to an exemplary embodiment of the present invention, one pre-charge voltage line is connected to an output data line, so that the same pre-charge voltage can be applied from the pre-charge voltage line to the output data line regardless of the color of each sub-pixel.

Figure 12:
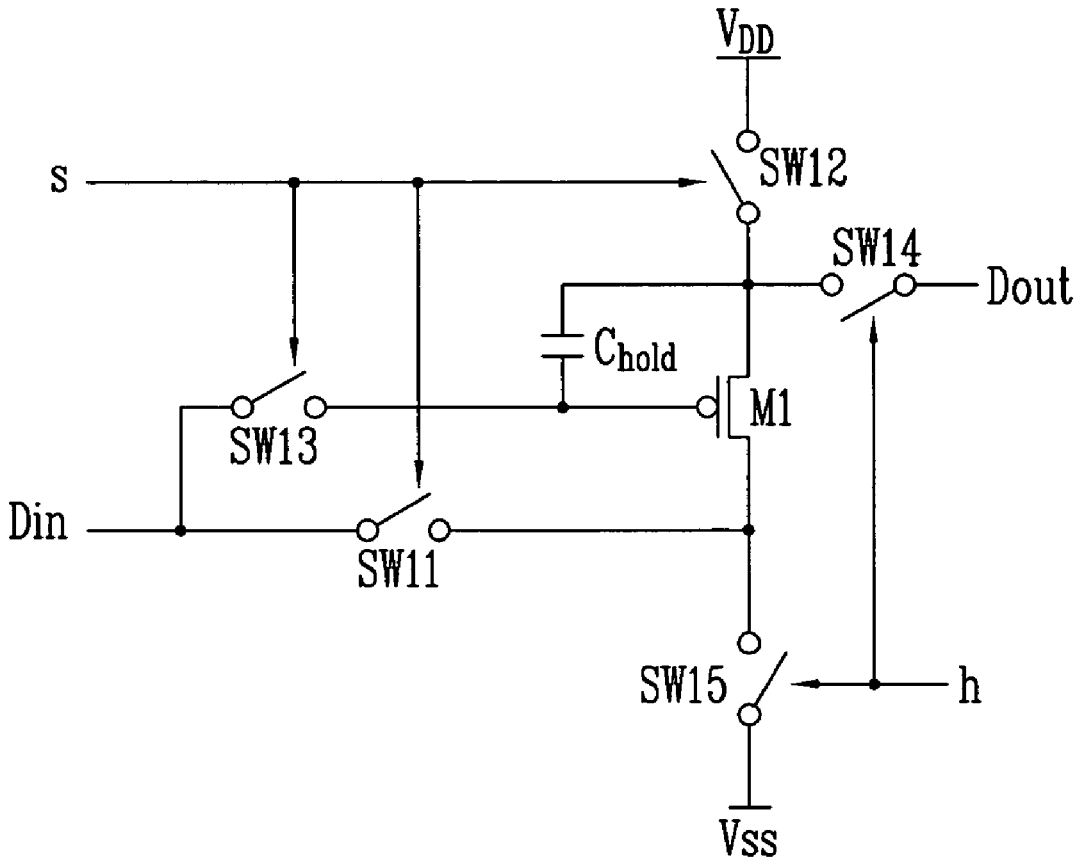
FIG. 12 is a view showing a sample/hold circuit employed in the demultiplexer according to one or more exemplary embodiments of the present invention.

FIG. 12 is a view showing a sample/hold circuit, which can be employed in the demultiplexer according to one or more exemplary embodiments of the present invention.

Referring to FIG. 12, a sample/hold circuit includes first through fifth switches SW11, SW12, . . . , SW15; a first transistor M1; and a hold capacitor $C_{hold}$.

The first switch SW11 electrically connects an input data line Din with a drain of the first transistor M1 in response to a sampling signal s. The second switch SW12 electrically connects a source of the first transistor M1 with a high voltage line $V_{DD}$ in response to the sampling signal s. The third switch SW13 electrically connects the input data line Din with a second terminal of the hold capacitor $C_{hold}$ in response to the sampling signal s. The fourth switch SW14 electrically connects an output data line Dout with the source of the first transistor M1 in response to a holding signal h. The fifth switch SW15 electrically connects the drain of the first transistor M1 with a low voltage line $V_{SS}$ in response to the holding signal h. The hold capacitor $C_{hold}$ has a first terminal connected to the source of the first transistor M1, and the second terminal connected to a gate of the first transistor M1.

For a sampling period when the first through third switches SW11, SW12, SW13 are turned on in response to the sampling signal s, and the fourth and fifth switches SW14, SW15 are tuned off in response to the holding signal h, the current path from the high voltage line $V_{DD}$ to the input data line Din via the first transistor M1 is formed, thereby allowing the input data current $I_{Din}$ to be transmitted from the input data line Din to the first transistor M1. Thus, the hold capacitor $C_{hold}$ is charged with a voltage corresponding to the input data current $I_{Din}$ flowing to the first transistor M1.

Then, for a holding period when the first through third switches SW11, SW12, SW13 are turned off in response to the sampling signal s and the fourth and fifth switches SW14, SW15 are tuned on in response to the holding signal h, a current path from the data output line Dout to the low voltage line $V_{SS}$ via the first transistor M1 is formed, thereby allowing the current corresponding to the voltage charged in the hold capacitor $C_{hold}$, i.e., the current equivalent to the input data current $I_{Din}$ to be transmitted to the output data line Dout.

As described above, the sample/hold circuit allows the hold capacitor $C_{hold}$ to record the voltage corresponding to the input data current $I_{Din}$ in response to the sampling signal s, and transmits the current corresponding to the voltage recorded in the hold capacitor $C_{hold}$ to the output data line in response to the holding signal h. An output terminal of the data driver should be a current sink type where an external current flows into the data driver through the output terminal. The data driver having a current sink type output terminal decreases deviation in output current, requires a relatively low voltage level of a power, decreases the size of the chip due to the use of a low voltage device, and reduces the cost of a chip for the data driver. Accordingly, the sample/hold circuit shown in FIG. 12 has a current source type input terminal adapted to the current sink type output terminal of the data driver. That is, the current flows outwardly through the input terminal of the sample/hold circuit.

In the foregoing exemplary embodiments, the demultiplexer includes a sample/hold type 1:2 demultiplexing circuit. However, the demultiplexer is not limited to the 1:2 demultiplexing circuit, and may include various demultiplexing circuits such as a 1:3 demultiplexing circuit, or a 1:4 demultiplexing circuit.

In the foregoing exemplary embodiments, the sub-pixels connected to the output data lines include the red sub-pixel, the green sub-pixel and the blue sub-pixel. However, the sub-pixels may further include a white sub-pixel in addition to the red sub-pixel, the green sub-pixel and the blue sub-pixel.

As described above, exemplary embodiments of the present invention provide an organic electroluminescent display and a demultiplexer, in which a data driver is simplified, and a data line is pre-charged with adapted voltage before programming the data, thereby reducing data programming time.

Further, exemplary embodiments of the present invention provide an organic electroluminescent display and a demultiplexer, which employ current programming type pixel circuits to lower data currents, thereby reducing power consumption.

Although certain exemplary embodiments of the present invention have been shown and described, it would be appreciated by those skilled in the art that changes may be made to these exemplary embodiments without departing from the spirit or scope of the present invention, the scope of which is defined in the claims and their equivalents.

What is claimed is:

1. A display device comprising:

a plurality of pixels for displaying an image corresponding to first data currents, each of the pixels including a plurality of sub-pixels;

a plurality of scan lines through which scan signals are applied to the plurality of pixels;

a plurality of first data lines through which the first data currents are transmitted to the plurality of pixels;

a scan driver for outputting the scan signals to the plurality of scan lines;

a data driver for transmitting second data currents to a plurality of second data lines; and a demultiplexer comprising a plurality of demultiplexing circuits, each of the demultiplexing circuits for demultiplexing a corresponding one of the second data currents transmitted through one of the second data lines into at least two of the first data currents, and for transmitting the at least two of the first data currents to at least two of the first data lines, wherein a pre-charge voltage is applied to all of the first data lines in the display device before the first data currents are respectively transmitted to the first data lines, wherein at least one of the demultiplexing circuits comprises:

a plurality of sample/hold circuits for sampling the corresponding one of the second data currents in response to sampling signals, and for transmitting the at least two of the first data currents corresponding to the corresponding one of the second data currents to the at least two of the first data lines in response to holding signals; and a plurality of pre-charge switches, each of the pre-charge switches for applying the pre-charge voltage to a corresponding one of the at least two of the first data lines in response to a pre-charging signal, wherein the plurality of sample/hold circuits comprise a first group sample/hold circuit and a second group sample/hold circuit, wherein the second group sample/hold circuit outputs at least one of the at least two of the first data currents corresponding to at least one previously sampled said corresponding one of the second data currents for a period when the first group sample/hold circuit samples the corresponding one of the second data currents, and the first group sample/hold circuit outputs at least another one of the at least two of the first data currents corresponding to at least another previously sampled said corresponding one of the second data currents for a period when the second group sample/hold circuit samples the corresponding one of the second data currents, and wherein at least one of the sample/hold circuits comprises:

a first transistor having a source, a drain and a gate;

a hold capacitor having a first terminal connected to the source of the first transistor and a second terminal connected to the gate of the first transistor;

a first switch for connecting the one of the second data lines to the drain of the first transistor in response to a corresponding one of the sampling signals;

a second switch for connecting the source of the first transistor to a high voltage line in response to the corresponding one of the sampling signals;

a third switch for connecting the one of the second data lines to the second terminal of the hold capacitor in response to the corresponding one of the sampling signals;

a fourth switch for connecting the corresponding one of the at least two of the first data lines to the source of the first transistor in response to a corresponding one of the holding signals; and a fifth switch for connecting the drain of the first transistor to a low voltage line in response to the corresponding one of the holding signals.

2. The display device according to claim 1 wherein the sampling signals and the holding signals are periodic signals, each including a sampling period and a holding period, wherein the corresponding one of the sampling signals turns on the first, second and third switches during the sampling period, and turns off the first, second and third switches during the holding period, and wherein the corresponding one of the holding signals turns off the fourth and fifth switches during the sampling period, and turns on the fourth and fifth switches during the holding period.

3. The display device according to claim 1, wherein each of the pre-charge switches applies the pre-charge voltage from the one of the second data lines to the corresponding one of the at least two of the first data lines in response to the pre-charging signal.

4. The display device according to claim 3, wherein the at least two of the first data lines connected to one of the demultiplexing circuits are connected to different color sub-pixels among the sub-pixels of the pixels.

5. The display device according to claim 3, wherein the at least two of the first data lines connected to one of the demultiplexing circuits are connected to sub-pixels having the same color, among the sub-pixels of the pixels.

6. The display device according to claim 1, wherein each of the pre-charge switches applies the pre-charge voltage from one of a plurality of pre-charge voltage lines to the corresponding one of the at least two of the first data lines in response to the pre-charging signal.

7. The display device according to claim 6, wherein the pre-charge voltage lines of the demultiplexer comprises:

a red sub-pixel pre-charge voltage line through which the pre-charge voltage is applied to at least one of the first data lines connected to a red sub-pixel among the sub-pixels;

a green sub-pixel pre-charge voltage line through which the pre-charge voltage is applied to at least one of the first data lines connected to a green sub-pixel among the sub-pixels; and a blue sub-pixel pre-charge voltage line through which the pre-charge voltage is applied to at least one of the first data lines connected to a blue sub-pixel among the sub-pixels.

8. The display device according to claim 1, wherein the pre-charge switches of the at least one of the demultiplexing circuits is turned off for a period when the plurality of sample/hold circuits included in the at least one of the demultiplexing circuits sample the corresponding one of the second data currents and for a period when one of the at least two of the first data currents corresponding to the sampled corresponding one of the second data currents is transmitted to the corresponding one of the at least two of the first data lines, and is turned on before the one of the at least two of the first data currents corresponding to the sampled corresponding one of the second data currents is transmitted to the corresponding one of the at least two of the first data lines.

9. A demultiplexer comprising:

a plurality of demultiplexing circuits;

a plurality of sample signal lines through which sampling signals are applied to the demultiplexing circuits;

first and second hold signal lines through which holding signals are applied to the demultiplexing circuits; and a pre-charge signal line through which a pre-charging signal is applied to the demultiplexing circuits, wherein at least one of the demultiplexing circuits demultiplexes an input data current transmitted through an input data line into output data currents in response to the sampling and holding signals, and transmits the output data currents to a plurality of output data lines, wherein a pre-charge voltage is applied to all of the output data lines associated with to the demultiplexer before the output data currents are respectively transmitted to the output data lines, wherein the at least one of the demultiplexing circuits comprises:

first and second group sample/hold circuits, each comprising at least one sample/hold circuit, for sampling the input data current and for transmitting the output data currents corresponding to the sampled input data current to the output data lines, and a plurality of pre-charge switches through which the pre-charge voltage is applied to the output data lines, and wherein the at least one sample/hold circuit comprises:

a first transistor having a source, a drain and a gate;

a hold capacitor having a first terminal connected to the source of the first transistor and a second terminal connected to the gate of the first transistor;

a first switch for connecting the input data line to the drain of the first transistor in response to one of the sampling signals;

a second switch for connecting the source of the first transistor to a high voltage line in response to the one of the sampling signals;

a third switch for connecting the input data line to the second terminal of the hold capacitor in response to the one of the sampling signals;

a fourth switch for connecting one of the output data lines to the source of the first transistor in response to one of the holding signals; and a fifth switch for connecting the drain of the first transistor to a low voltage line in response to the one of the holding signals.

10. The demultiplexer according to claim 9, wherein the pre-charge voltage having a same voltage level is applied to the plurality of output data lines.

11. The demultiplexer according to claim 9, wherein the pre charge voltage having a same voltage level is applied to output data lines connected to a sub-pixel group having the same color among the plurality of output data lines.

12. The demultiplexer according to claim 9, wherein the pre-charge switches of the at least one of the demultiplexing circuits are turned off for a period when the plurality of sample/hold circuits included in the at least one of the demultiplexing circuits sample the input data current and for a period when one of the output data currents corresponding to the sampled input data current is transmitted to one of the output data lines, and is turned on before the one of the output data currents corresponding to the sampled input data current is transmitted to the one of the output data lines.

13. The demultiplexer according to claim 9, wherein the sampling signals and the holding signals are periodic signals including periods, and the periods include a sampling period and a holding period, wherein at least one of the sampling signals turns on the first, second and third switches during the sampling period, and turns off the first, second and third switches during the holding period, and wherein at least one of the holding signals turns off the fourth and fifth switches during the sampling period, and turns on the fourth and fifth switches during the holding period.

14. A demultiplexer comprising:

a plurality of demultiplexing circuits;

a plurality of sample signal lines through which sampling signals are applied to the demultiplexing circuits;

first and second hold signal lines through which holding signals are applied to the demultiplexing circuits;

a pre-charge signal line through which a pre-charging signal is applied to the demultiplexing circuits; and a pre-charge voltage line through which a pre-charge voltage is applied to the demultiplexing circuits, wherein at least one of the demultiplexing circuits demultiplexes an input data current transmitted through an input data line into output data currents in response to the sampling and holding signals, and transmits the output data currents to a plurality of output data lines, wherein the pre-charge voltage is applied to all of the output data lines associated with the demultiplexer before the output data currents are respectively transmitted to the output data lines, wherein the at least one of the demultiplexing circuits comprises:

first and second group sample/hold circuits, each comprising at least one sample/hold circuit, for sampling the input data current and for transmitting the output data currents corresponding to the sampled input data current to the output data lines; and a plurality of pre-charge switches through which the pre-charge voltage is applied to the output data lines, and wherein the at least one sample/hold circuit comprises:

a first transistor having a source, a drain and a gate;

a hold capacitor having a first terminal connected to the source of the first transistor and a second terminal connected to the gate of the first transistor;

a first switch for connecting the input data line to the drain of the first transistor in response to one of the sampling signals;

a second switch for connecting the source of the first transistor to a high voltage line in response to the one of the sampling signals;

a third switch for connecting the input data line to the second terminal of the hold capacitor in response to the one of the sampling signals;

a fourth switch for connecting one of the output data lines to the source of the first transistor in response to one of the holding signals; and a fifth switch for connecting the drain of the first transistor to a low voltage line in response to the one of the holding signals.

15. The demultiplexer according to claim 14, wherein the pre charge voltage having a same voltage level is applied to the plurality of output data lines.

16. The demultiplexer according to claim 14, wherein the pre-charge voltage having a same voltage level is applied to output data lines connected to a sub-pixel group having the same color among the plurality of output data lines.

17. The demultiplexer according to claim 14, wherein the pre-charge switches of the at least one of the demultiplexing circuits is turned off for a period when the plurality of sample/hold circuits included in the at least one of the demultiplexing circuits samples the input data current and for a period when one of the output data currents corresponding to the sampled input data current is transmitted to one of the output data lines, and is turned on before the one of the output data currents corresponding to the sampled input data current is transmitted to the one of the output data lines.

18. The demultiplexer according to claim 14, wherein the sampling signals and the holding signals are a periodic signals having periods, and the periods include a sampling period and a holding period, wherein at least one of the sampling signals turns on the first, second and third switches during the sampling period, and turns off the first, second and third switches during the holding period, and wherein at least one of the holding signals turns off the fourth and fifth switches during the sampling period, and turns on the fourth and fifth switches during the holding period.

* * * * *

UNITED STATES PATENT AND TRADEMARK OFFICE

CERTIFICATE OF CORRECTION

PATENT NO. : 7,782,277 B2
APPLICATION NO. : 11/112835
DATED : August 24, 2010
INVENTOR(S) : Dong-Yong Shin It is certified that error appears in the above-identified patent and that said Letters Patent is hereby corrected as shown below:

On the Title Page

| | |
|---|---|
| (56) References Cited, page 2, | Delete "2004-336903m" |
| Other Publications, right column, line 24. | Insert -- 2004-336903, -- |

In the Claims

| | |
|---|---|
| Column 15, Claim 9, line 40. | Delete "to" |
| Column 18, Claim 18, line 14. | Delete "a" |

Signed and Sealed this
Twenty-eighth Day of August, 2012

David J. Kappos

David J. Kappos
*Director of the United States Patent and Trademark Office*